US011513465B2

(12) United States Patent
Abe et al.

(10) Patent No.: US 11,513,465 B2
(45) Date of Patent: Nov. 29, 2022

(54) DRUM CARTRIDGE AND IMAGE FORMING APPARATUS

(71) Applicant: Brother Kogyo Kabushiki Kaisha, Nagoya (JP)

(72) Inventors: Koji Abe, Okazaki (JP); Keita Inoue, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/336,461

(22) Filed: Jun. 2, 2021

(65) Prior Publication Data

US 2021/0286313 A1 Sep. 16, 2021

Related U.S. Application Data

(63) Continuation of application No. 17/013,979, filed on Sep. 8, 2020, now Pat. No. 11,061,359.

(30) Foreign Application Priority Data

Sep. 11, 2019 (JP) ..... JP2019-165356

(51) Int. Cl.
*G03G 21/18* (2006.01)
*G03G 21/16* (2006.01)

(52) U.S. Cl.
CPC ..... *G03G 21/1652* (2013.01); *G03G 21/1814* (2013.01)

(58) Field of Classification Search
CPC ..... G03G 21/1652; G03G 21/1814
USPC ..... 399/107, 110, 111
See application file for complete search history.

(56) References Cited

U.S. PATENT DOCUMENTS

| | | | |
|---|---|---|---|
| 8,565,637 | B2 | 10/2013 | Itabashi et al. |
| 8,737,867 | B2 | 5/2014 | Sato et al. |
| 2019/0041792 | A1 | 2/2019 | Kishi et al. |

FOREIGN PATENT DOCUMENTS

| | | | |
|---|---|---|---|
| JP | 2005-025944 | * | 1/2005 |
| JP | 2006-163143 | A | 6/2006 |
| JP | 2014-081576 | A | 5/2014 |
| JP | 2019-028345 | A | 2/2019 |

* cited by examiner

*Primary Examiner* — Hoan H Tran
(74) *Attorney, Agent, or Firm* — Burr & Brown, PLLC

(57) ABSTRACT

A drum cartridge including a photosensitive drum, a drum frame configured to retain the photosensitive drum and to accept a developing cartridge including a toner memory, which stores information concerning the developing cartridge, a first connector electrically connectable with the toner memory in the developing cartridge under a condition where the developing cartridge is attached to the drum frame, a relay board electrically connectable with the first connector, a second connector electrically connectable with a connector in an image forming apparatus and with the toner memory through the relay board, and a thermistor electrically connectable with the relay board, is provided.

16 Claims, 10 Drawing Sheets

DRUM CARTRIDGE AND IMAGE FORMING APPARATUS

CROSS REFERENCE TO RELATED APPLICATION

This application is a continuation application of U.S. patent application Ser. No. 17/013,979, filed Sep. 8, 2020 and claims priority under 35 U.S.C. § 119 from Japanese Patent Application No. 2019-165356, filed on Sep. 11, 2019, the entireties of which are incorporated herein by reference.

BACKGROUND

Technical Field

The following description is related to a drum cartridge and an image forming apparatus.

Related Art

Image forming apparatus for forming images electrophotographically, such as laser printer and LED printer, is known. The image forming apparatus may have a drum cartridge, and the drum cartridge may have a plurality of photosensitive drums. To the drum cartridge, a plurality of developing cartridges may be detachably attachable. The developing cartridges and the photosensitive drums may be in an arrangement such that, when the developing cartridges are attached to the drum cartridge, developing rollers in the developing cartridges contact the photosensitive drums in the drum cartridge.

SUMMARY

Meanwhile, it is known that the image forming apparatus may have a thermistor, through which a temperature inside the image forming apparatus is measurable, at an area in proximity to the developing cartridge. The thermistor may be arranged on a main frame of the image forming apparatus, in particular, for example, on a part of the main frame located between the photosensitive drums and a fuser.

In this arrangement, however, in a case when the thermistor becomes inoperable, a user may not access the thermistor for exchange with another thermistor easily.

An aspect of the present disclosure is advantageous in that a drum cartridge and an image forming apparatus having a thermistor, which may be exchanged easily, are provided.

According to an aspect of the present disclosure, a drum cartridge is provided. The drum cartridge includes a photosensitive drum; a drum frame configured to retain the photosensitive drum and to accept a developing cartridge including a toner memory to be attached thereto, the toner memory storing information concerning the developing cartridge; a first connector electrically connectable with the toner memory in the developing cartridge under a condition where the developing cartridge is attached to the drum frame; a relay board electrically connectable with the first connector; a second connector electrically connectable with a connector in an image forming apparatus, the second connector being electrically connectable with the toner memory through the relay board; and a thermistor electrically connectable with the relay board.

According to another aspect of the present disclosure, an image forming apparatus, having a body frame, a body-side connector, and a drum cartridge configured to be detachably attached to the body frame, is provided. The drum cartridge includes a photosensitive drum, a drum frame configured to retain the photosensitive drum and to accept a developing cartridge including a toner memory to be attached thereto, the toner memory storing information concerning the developing cartridge; a first connector electrically connectable with the toner memory in the developing cartridge under a condition where the developing cartridge is attached to the drum frame; a relay board electrically connectable with the first connector; a second connector electrically connectable with the body-side connector, the second connector being electrically connectable with the toner memory through the relay board; and a thermistor electrically connectable with the relay board.

BRIEF DESCRIPTION OF THE ACCOMPANYING DRAWINGS

DETAILED DESCRIPTION

Hereinafter, with reference to the accompanying drawings, an embodiment according to an aspect of the present disclosure will be described in detail.

In the following description, a direction of a drum axis, which is a rotation axis for a photosensitive drum, in a drum cartridge will be called as a first direction, and a direction, along which a plurality of photosensitive drums align, will be called as a second direction. The first direction intersects and the second direction intersect each other, and more preferably, may intersect orthogonally with each other. A direction intersecting, preferably orthogonally, with the first direction and with the second direction will be called as a third direction.

1. Overall Configuration of Image Forming Apparatus

Figure 1:
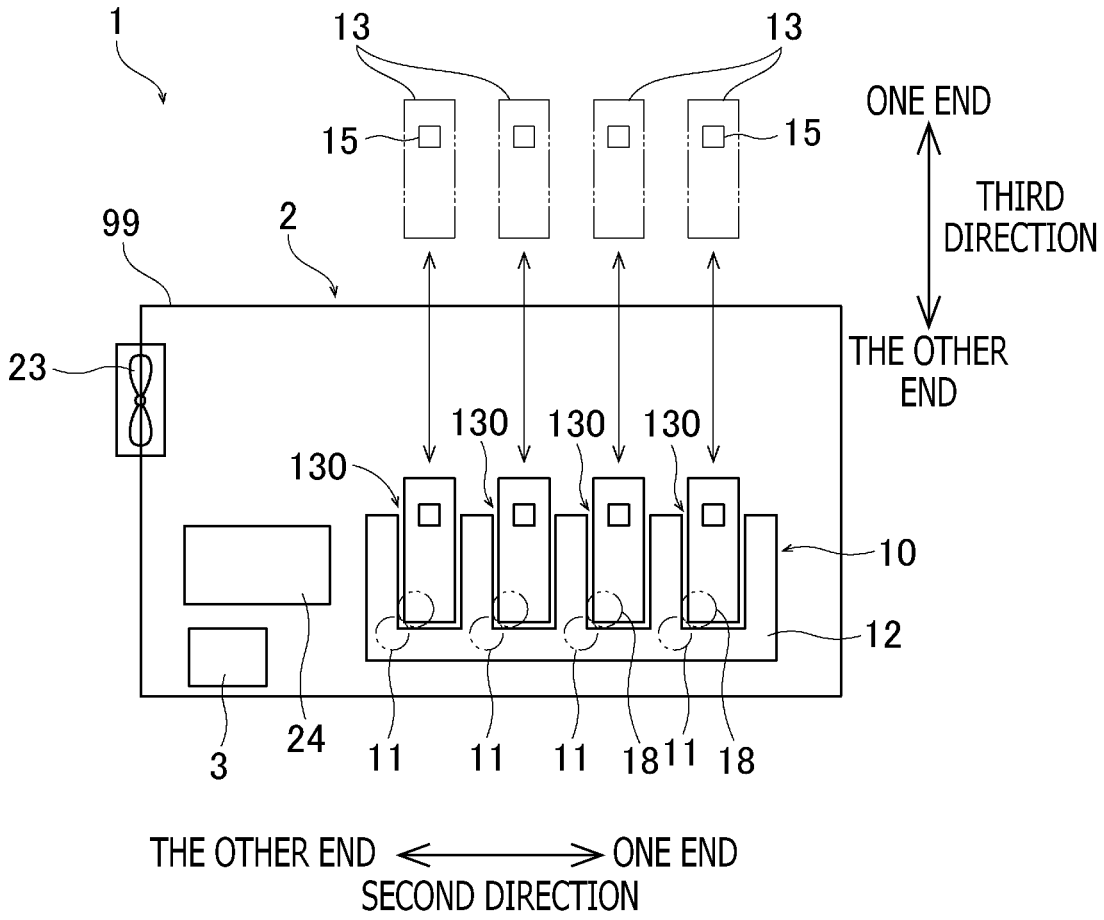
FIG. 1 is an illustrative view of an overall configuration of an image forming apparatus according to an embodiment of the present disclosure.

FIG. 1 is an illustrative view of an overall configuration of an image forming apparatus 1 according to the embodiment of the present disclosure. The image forming apparatus 1 is an electro-photographic printer, which may include, for example, a laser printer and an LED printer. As shown in FIG. 1, the image forming apparatus 1 includes a drum cartridge 10 and a main body 2. The drum cartridge 10 is detachably attachable to a body frame 99 of the main body 2. The main body 2 includes a controller 3, a fan 23, and a fuser 24. The fan 23 may generate air currents inside the body frame 99 of the main body 2. The fuser 24 may fuse a developing agent, e.g., toner, and fix the fused developing agent onto a sheet.

2. Configuration of the Drum Cartridge

Figure 2:
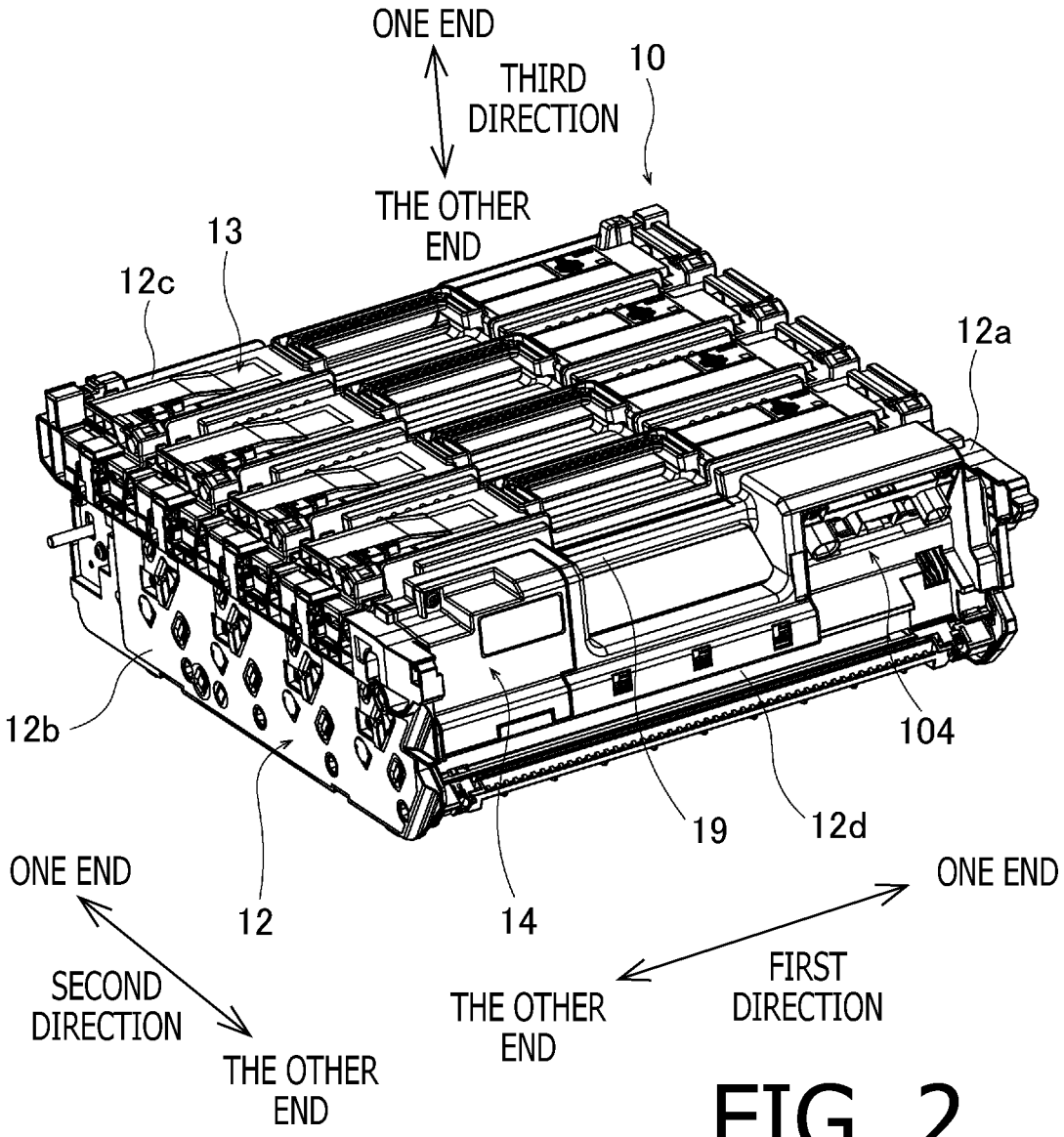
FIG. 2 is a perspective view of a drum cartridge according to the embodiment of the present disclosure.
Figure 3:
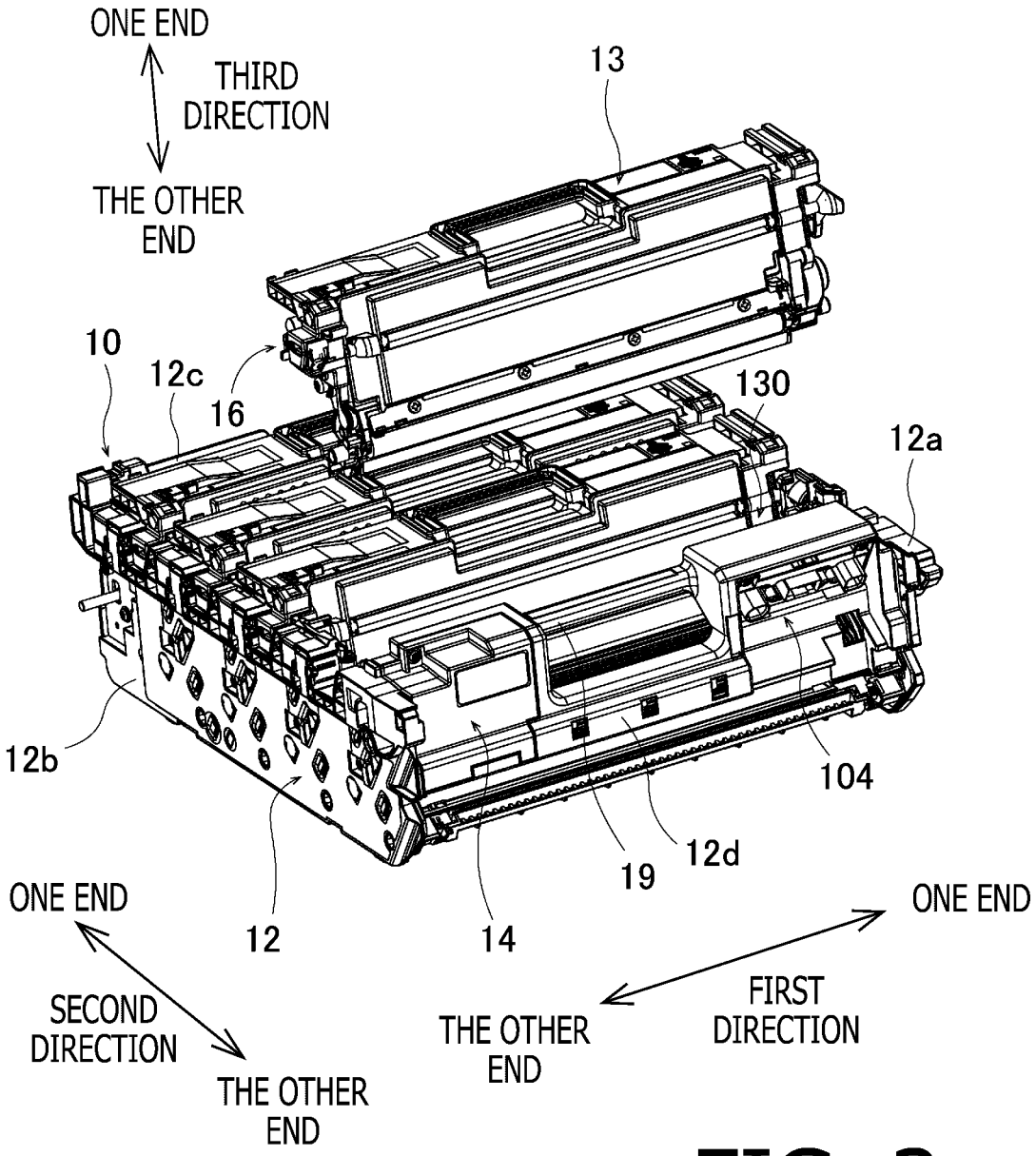
FIG. 3 is a perspective view of the drum cartridge according to the embodiment of the present disclosure with one of developing cartridges being detached from the drum cartridge.

In the following paragraphs, described in detail will be the drum cartridge 10. FIG. 2 is a perspective view of the drum cartridge 10. FIG. 3 is a perspective view of the drum cartridge 10, with one of developing cartridges 13 being detached therefrom. The drum cartridge 10 includes four (4) photosensitive drums 11 (see FIG. 1), a drum frame 12, four (4) developing cartridges 13, a cover 14, and a circuit unit 100 (see FIG. 5). Each of the developing cartridges 13 includes a toner memory 15.

The photosensitive drums 11 each have a cylindrical outer peripheral surface centered at the drum axis, which is the rotation axis, extending in the first direction. The outer peripheral surfaces of the photosensitive drums 11 are covered with a photosensitive material. The photosensitive drums 11 are rotatable about the drum axes, which extend in the first direction.

The drum frame 12 is a frame to retain the photosensitive drums 11 rotatably. The drum frame 12 retains the photosensitive drums 11 in an arrangement such that the photosensitive drums 1 are spaced apart from one another in the second direction. The drum frame 12 includes a first frame 12*a*, a second frame 12*b*, a third frame 12*c*, and a fourth frame 12*d*.

The first frame 12*a* is located at one end of the photosensitive drums 11 in the first direction. The second frame 12*b* is located to be spaced apart from the first frame 12*a* in the first direction. The first frame 12*a* and the second frame 12*b* extend in parallel with each other.

The third frame 12*c* connects one end of the first frame 12*a* in the second direction and one end of the second frame 12*b* in the second direction with each other. The third frame 12*c* is located on an upstream side in an attaching direction, in which the drum cartridge 10 is moved to be attached to the body frame 99 of the main body 2. The fourth frame 12*d* connects the other end of the first frame 12*a* in the second direction and the other end of the second frame 12*b* in the second direction with each other. The fourth frame 12*d* is located on a downstream side in the attaching direction, in which the drum cartridge 10 is moved to be attached to the body frame 99 of the main body 2. The fourth frame 12*d* is located to be spaced apart from the third frame 12*c* in the second direction. The third frame 12*c* and the fourth frame 12*d* extend in parallel with each other.

As shown in FIGS. 1 and 3, the drum frame 12 includes a plurality of slots 130, which are arranged to be spaced apart from one another in the second direction. The developing cartridges 13 are attachable to the slots 130. The developing cartridges 13 may be fitted in the slots 130 to be attached to the drum frame 12. In other words, the drum frame 12 may accept the plurality of developing cartridge 13 to be attached thereto in the slots 130. When the developing cartridges 13 are attached to the slots 130, outer peripheral surfaces of the developing rollers 18 in the developing cartridges 13 may contact the outer peripheral surfaces of the photosensitive drums 11.

Under a condition where the developing cartridges 13 are attached to the drum frame 12, the developing cartridges 13 are located between an inner surface of the first frame 12*a* and an inner surface of the second frame 12*b* in the first direction. In the meantime, the developing cartridges 13 are located to be spaced apart from one another between the third frame 12*c* and the fourth frame 12*d* in the second direction.

The cover 14 may cover a part of the circuit unit 100 (see FIG. 5) located on an outer surface of the fourth frame 12*d*. The cover 14 may be attached to the fourth frame 12*d* through fastening member such as, for example, screws.

3. Overall Configuration of the Circuit Unit

An overall configuration of the circuit unit 100 will be described below.

Figure 5:
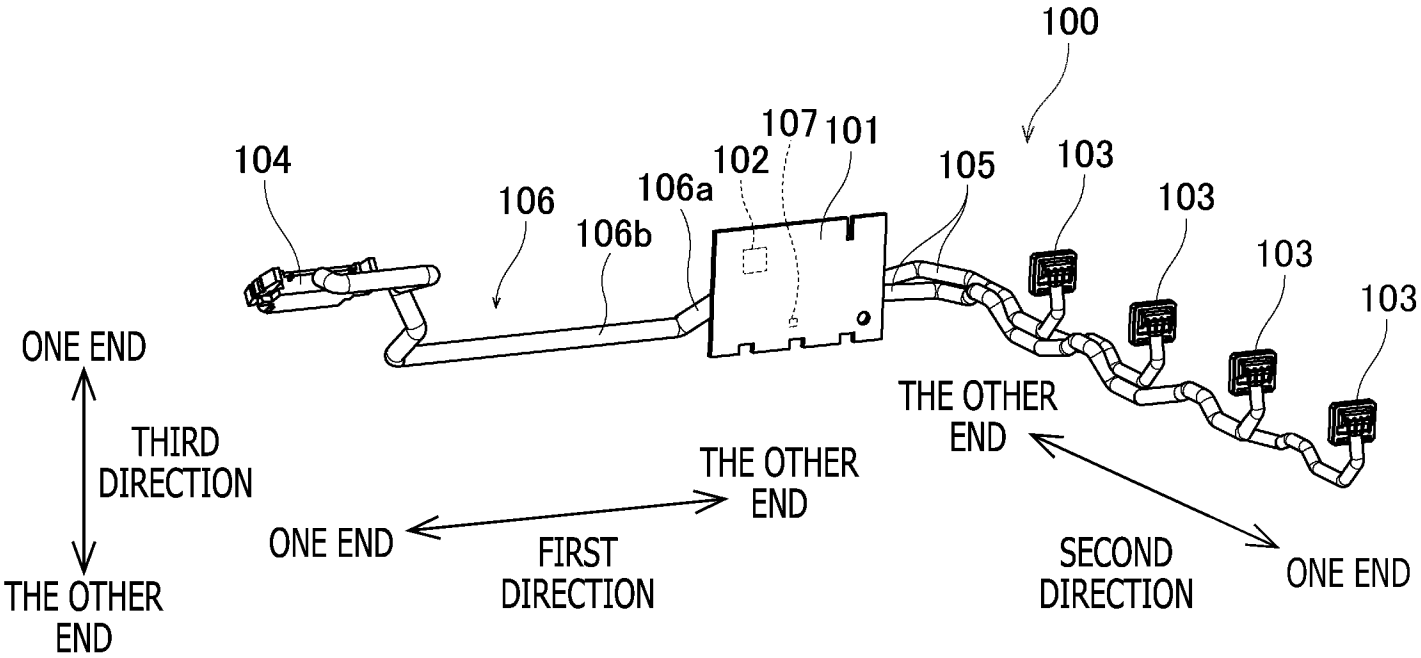
FIG. 5 is a perspective view of a circuit unit in the image forming apparatus according to the embodiment of the present disclosure.

FIG. 5 is a perspective view of the circuit unit 100. The circuit unit 100 includes a relay board 101, a drum memory 102, a plurality of first connectors 103, a second connector 104, first wires 105, a second wire 106, and a thermistor 107.

The drum memory 102 is a memory medium, in and from which information may be written and read. The second connector 104 is connected electrically with the controller 3 in the main body 2 under a condition where the drum cartridge 10 is attached to the body frame 99 of the main body 2. The first connectors 103 are, under the condition where the developing cartridges 13 are attached to the drum cartridge 10, each connected electrically with the toner memory 15 in the developing cartridge 13. In the present embodiment, while a quantity of the developing cartridges 13 attachable to the drum cartridge 10 is four (4), a quantity of the first connectors 103 is four (4) likewise.

The first wires 105 connect the first connectors 103 and the relay board 101 electrically. The second wire 106 connects the relay board 101 and the second connector 104 electrically.

The developing cartridges 13 each include a toner circuit board 60 (see FIG. 7), the toner memory 15 (see FIG. 1), and a toner-side connector 16 (see FIG. 3). The toner memory 15 is a memory medium, in and from which information may be written and read. The toner-side connector 16 may, under the condition where the developing cartridge 13 is attached to the drum cartridge 10, contact the first connector 103 in the drum cartridge 10 and is connected electrically with the first connector 103.

In the arrangement of the drum cartridge 10 and the developing cartridges 13 described above, when the developing cartridges 13 are attached to the drum cartridge 10, the toner circuit boards 60 in the developing cartridges 13 are connected to the relay board 101 electrically. Moreover, when the drum cartridge 10 with the developing cartridges 13 attached thereto is attached to the main body 2, the relay board 101 in the drum cartridge 10 is connected to the controller 3 (see FIG. 1) electrically. Thus, the toner circuit boards 60 in the developing cartridges 13 are connected electrically with the controller 3 in the main body 2 through the relay board 101. In this regard, the relay board 101 may relay information to be exchanged between the toner circuit boards 60 in the developing cartridges 13 and the controller 3 in the main body 2.

4. Detailed Configuration of the Circuit Unit

Figure 4:
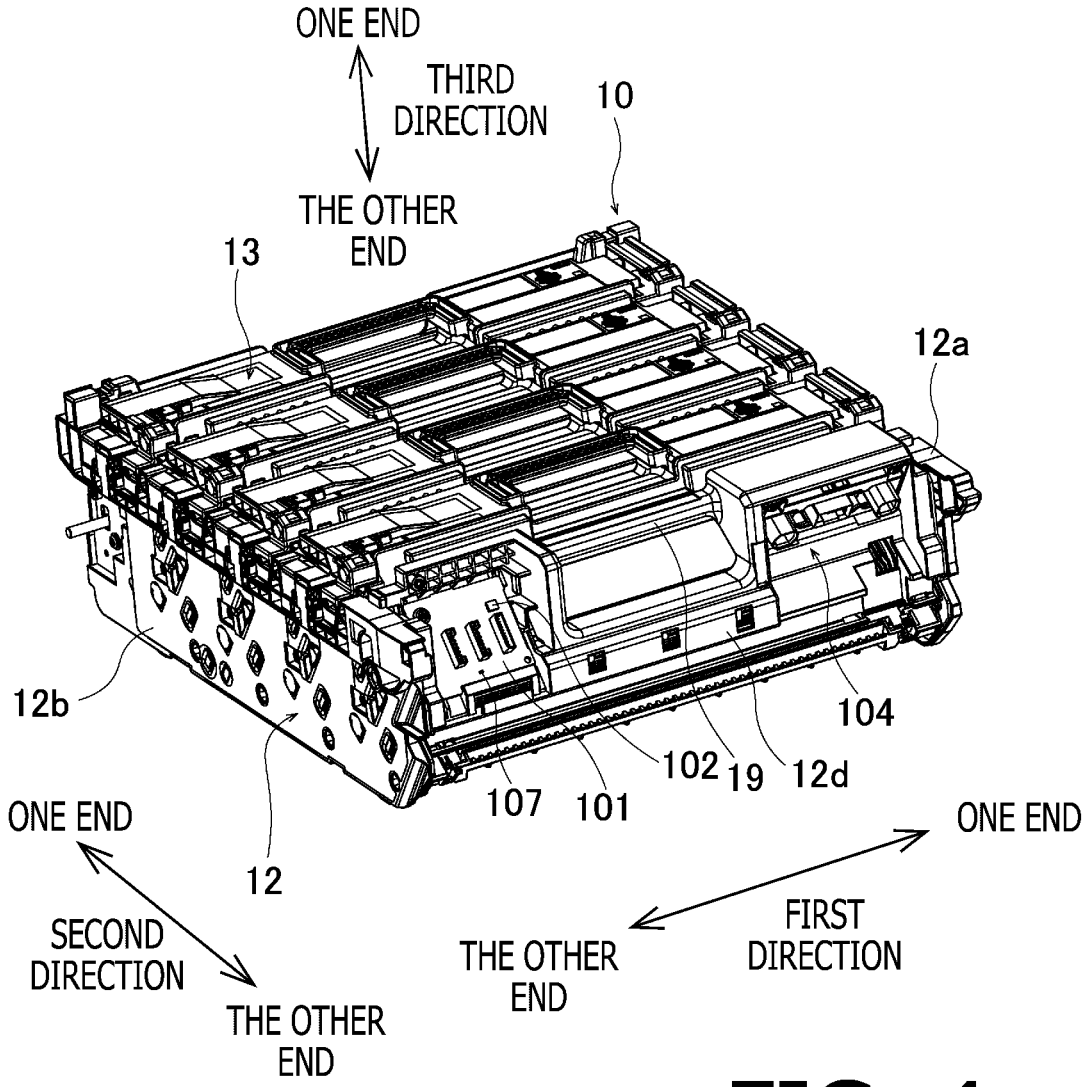
FIG. 4 is a perspective view of the drum cartridge according to the embodiment of the present disclosure with a cover being removed from the drum cartridge.

The circuit unit 100 will be described below in further detail. As shown in FIG. 5, the relay board 101 is a circuit board electrically connected with the first connectors 103 and the second connector 104. As shown in FIG. 4, the relay board 101 is located on an outer surface of the fourth frame 12*d* in the drum frame 12 on a side toward the other end in the first direction.

As shown in FIG. 4, the relay board 101 is arranged to incline with respect to the second direction. Moreover, the outer surface of the fourth frame 12*d* in the drum frame 12 on the side toward the other end in the first direction inclines with respect to the second direction likewise to spread along the relay board 101. For example, the outer surface of the fourth frame 12*d* on the side toward the other end in the first direction may incline to be closer to the third frame 12*c* as the outer surface of the fourth frame 12 extends toward one end in the third direction, e.g., upward, and the relay board 101 may incline along the inclination of the fourth frame 12*d*. As shown in FIG. 3, the relay board 101 is covered by the cover 14 under a normal condition.

The relay board 101 is a board that relays information electrically between the first connectors 103 and the second connector 104. As shown in FIG. 5, the relay board 101 and the first connectors 103 are connected electrically through the first wires 105. Meanwhile, the relay board 101 and the second connector 104 are connected electrically through the second wire 106. The first wires 105 and the second wire 106 may be, for example, wire harnesses including a plurality of conductive wires.

Figure 6:
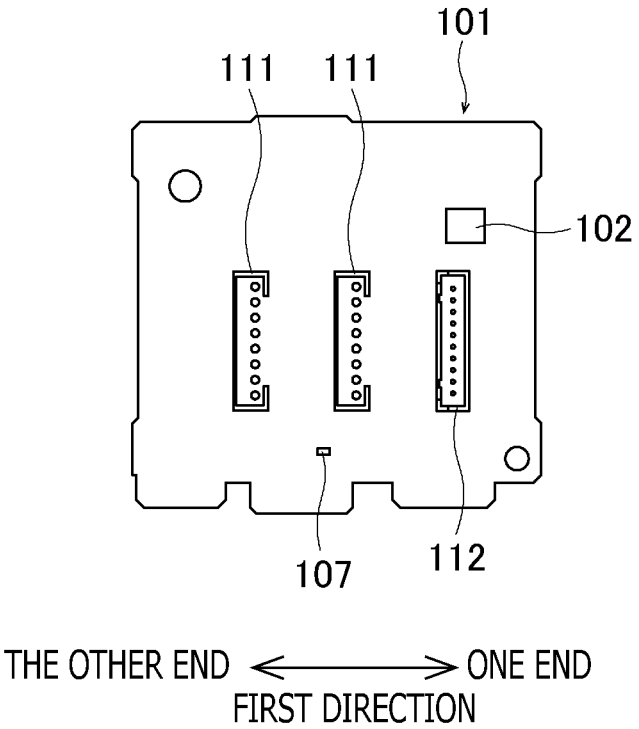
FIG. 6 is a plan view of a relay board according to the embodiment of the present disclosure.

FIG. 6 is a plan view of the relay board 101. The drum memory 102 is, as shown in FIG. 6, mounted on the relay board 101. For example, the drum memory 102 may be located on an outer surface of the relay board 101 on a side toward the other end in the second direction. The drum memory 102 may store various kinds of information related to the drum cartridge 10. For example, the drum memory 102 may store at least one of information to identify the drum cartridge 10 and information to indicate attribute of the drum cartridge 10. The information to identify the drum cartridge 10 may include at least one of, for example, a serial product number of the drum cartridge 10 and an identification code indicating authenticity of the drum cartridge 10. The information indicating attribute of the drum cartridge 10 may include, for example, at least one of model(s), in which the drum cartridge 10 is operable, specification of the drum cartridge 10, a lifetime of the photosensitive drums 11, charging characteristics of the photosensitive drums 11, information indicating newness or oldness, rotated amounts of the photosensitive drums 11, lengths of time in which the photosensitive drums 11 have been charged, printed quantity, and history of errors.

Each of the first connectors 103 is a part, through which the developing cartridge 13 is connected electrically to the toner-side connector 16 (see FIG. 3), when the developing cartridge 13 is attached to one of the slots 130 in the drum frame 12. The first connector 103 is located on an end of the slot 130 on a side toward the other end in the first direction. The first connector 103 may be fixed to, for example, a surface of the drum frame 12. The first connector 103 may be either fixed immovably with respect to the drum frame 12 or retained movably to a small extent on the drum frame 12.

The first wires 105 to connect the first connectors 103 with the relay board 101 are arranged on an inner surface of the second frame 12*b* in the drum frame 12. The first wires 105 extend in the second direction.

The second connector 104 is a part, through which the drum cartridge 10 is connected electrically to a body-side connector (not shown), which is arranged inside the main body 2, when the drum cartridge 10 with the developing cartridges 13 being attached thereto is attached to the body frame 99 of the main body 2. The body-side connector is connected electrically with the controller 3. The second connector 104 is located on an outer surface of the fourth frame 12*d* on a side toward the one end in the first direction.

The second wire 106 to connect the relay board 101 with the second connector 104 extends in the first direction. The second wire includes a first part 106*a* and a second part 106*b*. The first part 106*a* is a part of the second wire 106 closer to the relay board 101 than the second part 106*b* and is arranged on an outer surface of the fourth frame 12*d* of the drum frame 12. The second part 106*b* is the other part of the second wire 106 than the first part 106*a*. The second part 106*b* is arranged on an inner surface of the fourth frame 12*d* of the drum frame 12.

As shown in FIG. 6, the thermistor 107 is mounted on the relay board 101. For example, the thermistor 107 may be arranged on an outer surface of the relay board 101 toward the other end in the second direction. The thermistor 107 is an element to detect a temperature of the atmosphere in the main body 2. The thermistor 107 includes a variable resistor, of which resistance value may vary depending on a temperature. As mentioned above, the relay board 101 is covered 14 by the cover 14 under the normal condition. Therefore, to neither the relay board 101 nor the thermistor 107, toner in the main body 2 may adhere easily.

Meanwhile, within the drum cartridge 10, under the condition where the developing cartridges 13 are attached to the drum frame 12, and where the drum cartridge 10 is attached to the body frame 99, the thermistor 107 is located between the developing cartridges 13 and the fuser 24.

Further, the relay board 101 has connectors 111, to which ends of the first wires 105 are connected, and a connector 112, to which an end of the second wire 106 is connected. The connectors 111 and the connector 112 are arranged on the outer surface of the relay board 101. The first wires 105 extending from the connectors 111 may curve underneath the cover 14 and further extend in the second direction. The second wire 106 extending from the connector 112 may curve underneath the cover 14 and further extend in the first direction.

As described earlier, the second connector 104 is located on the side toward the one end of the fourth frame 12*d* in the first direction, and the relay board 101 is located on the side toward the other end of the fourth frame 12*d* in the first direction. In other words, on the outer surface of the fourth frame 12*d*, in a central area in the first direction, neither the second connector 104 nor the relay board 101 are arranged. In the present embodiment, at the central area of the fourth frame 12*d* in the first direction, arranged is a handle 19, which may be gripped by a user to grab the drum cartridge 10. The handle 19 is located between the second connector 104 and the relay board 101 in a view from the side toward the other end in the second direction. In other words, the handle 19 is located between the first connectors 104 and the relay board 101 in the first direction. Thus, on the outer surface of the fourth frame 12*d*, the second connector 104, the relay board 101, and the handle 19 are arranged.

5. Electrical Connections Among the Boards

Figure 7:
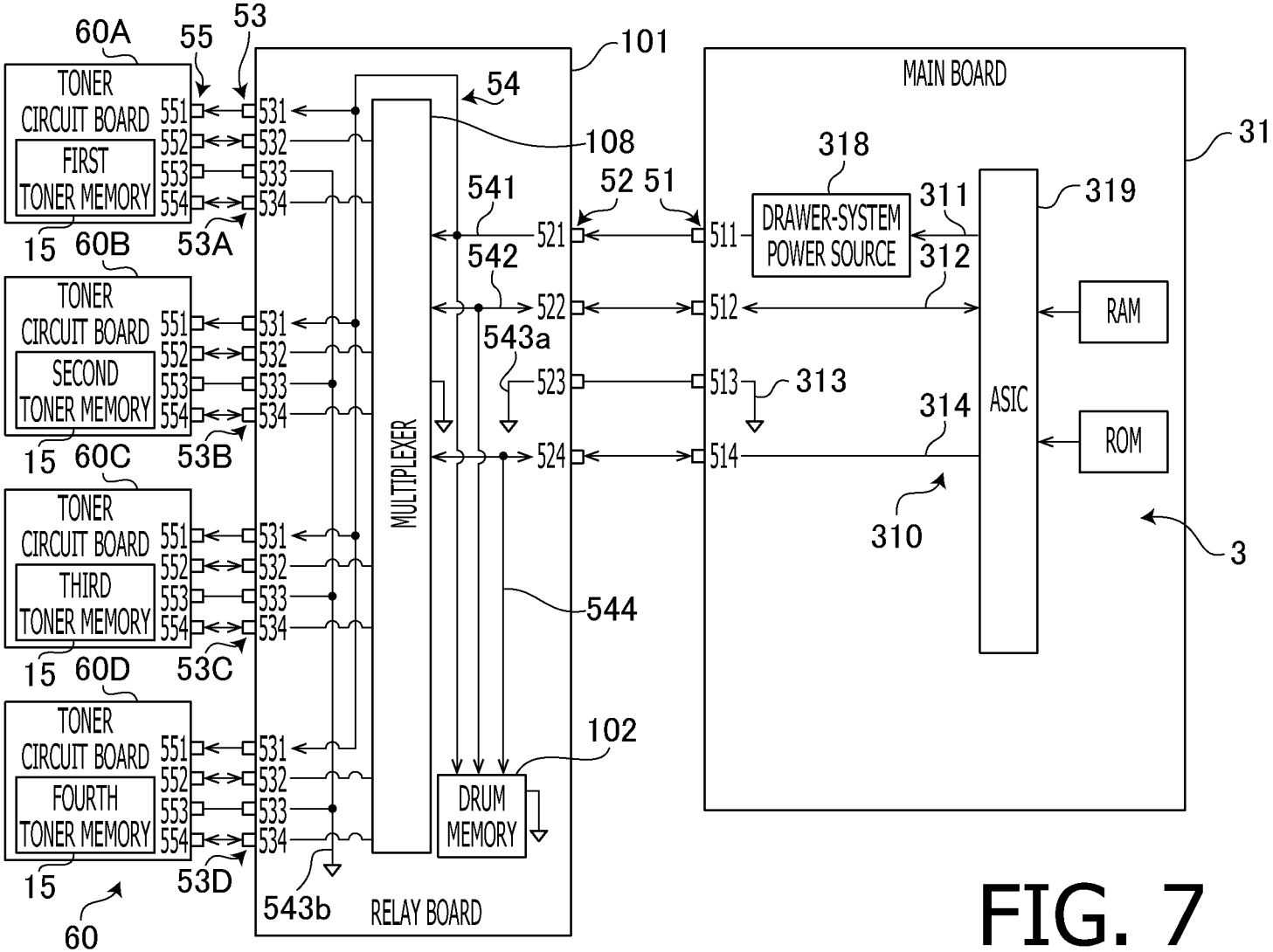
FIG. 7 illustrates arrangement and connections among boards in the developing cartridges, the drum cartridge, and the image forming apparatus according to the embodiment of the present disclosure.
Figure 8:
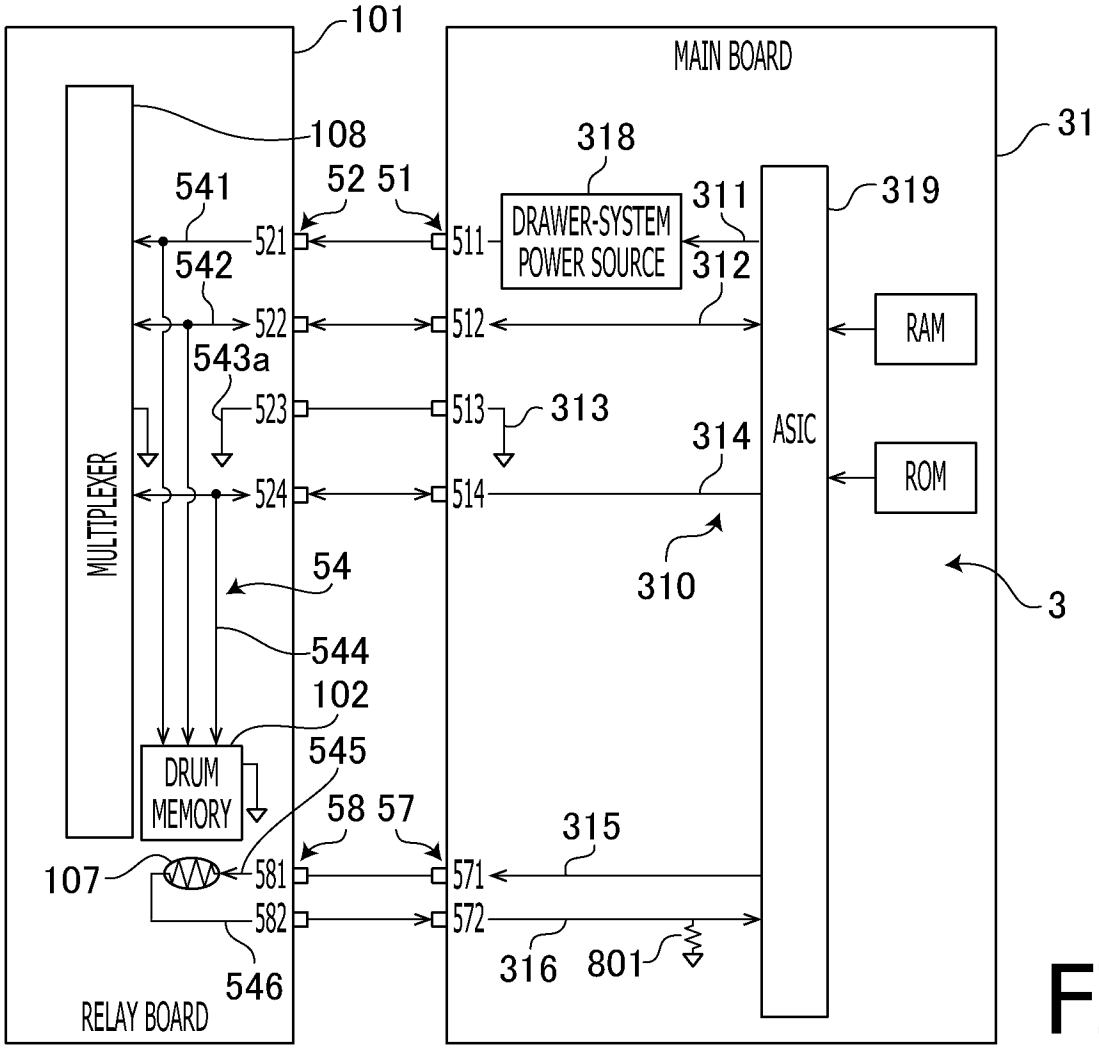
FIG. 8 illustrates arrangement and connections among the boards in the drum cartridge and the image forming apparatus according to the embodiment of the present disclosure.

In the following paragraphs, with reference to FIGS. 7-8, described in detail will be electrical connection among the relay board 101, the toner circuit boards 60, and the controller 3. FIGS. 7 and 8 illustrate arrangement and electrical connections among the controller 3, the relay board 101, and the toner circuit boards 60 in the image forming apparatus 1. It may be noted that illustration of the thermistor 107 is omitted in FIG. 7, and illustration of the toner circuit boards 60 is omitted in FIG. 8. As shown in FIGS. 7 and 8, the controller 3 is mounted on a main board 31. The main board 31 includes a main terminal 51, through which the main board 31 is connected with the relay board 101, a thermistor-assigned main terminal 57, and a main wire 310. The relay board 101 includes a first terminal 52, a second terminal 53, a thermistor-assigned terminal 58, and a relay wire 54. The toner circuit boards 60 each have a toner terminal, through which the toner circuit board 60 is connected with the relay board 101. Each of the main terminal 51, the thermistor-assigned main terminal 57, the first terminal 52, the second terminal 53, the thermistor-assigned terminal 58, and a toner terminal 55 is formed of a plurality of exposed conductors.

The main terminal 51 on the main board 31 is connected electrically with the first terminal 52 of the relay board 101, which is a part of the connector 112 shown in FIG. 6, through a main-body wire (not shown), the body-side connector (not shown), the second connector 104, and the second wire 106, under the condition where the drum cartridge 10 is attached to the body frame 99 of the main body 2. The main terminal 51 includes a main power-supplier terminal 511, a main data terminal 512, a main ground terminal 513, and a main clock terminal 514.

The thermistor-assigned main terminal 57 is connected electrically with the thermistor-assigned terminal 58 of the relay board 101, which is another part of the connector 112 shown in FIG. 6, through the body-side connector (not shown), the second connector 104, and the second wire 106, under the condition where the drum cartridge 10 is attached to the body frame 99 of the main body 2. The thermistor-assigned main terminal 57 includes a constant-voltage supplier terminal 571, and a measurer terminal 572.

The first terminal 52 on the relay board 101 includes a first power-supplier terminal 521, a first data terminal 522, a first ground terminal 523, and a first clock terminal 524.

The second terminal 53 is, under the condition where the developing cartridge 13 is attached to the drum frame 12 of the drum cartridge 10, connected electrically with the toner terminal 55 of the toner circuit board 60 in the developing cartridge 13 through the first wire 105, the first connector 103, and the toner-side connector 16. The second terminal 53 includes a plurality of second power-supplier terminals 531, a plurality of second data terminals 532, a plurality of second ground terminals 533, and a plurality of second clock terminals 534. In the present embodiment, quantities of the second power-supplier terminals 531, the second data terminals 532, the second ground terminals 533, and the second clock terminals 534 are all four (4): a total quantity of the terminals in the second terminal 53 is 16.

The thermistor-assigned terminal 58 includes a constant-voltage supplier terminal 581 and a measurer terminal 582.

In the following paragraphs, the four (4) developing cartridges 13 attachable to the drum cartridge 10 may be separately called as a first developing cartridge 13A, a second developing cartridge 13B, a third developing cartridge 13C, and a fourth developing cartridge 13D. Moreover, the toner circuit board 60 in the first developing cartridge 13A will be called as a first toner circuit board 60A, the toner circuit board 60 in the second developing cartridge 13B will be called as a second toner circuit board 60B, the toner circuit board 60 in the third developing cartridge 13C will be called as a third toner circuit board 60C, and the toner circuit board 60 in the fourth developing cartridge 13D will be called as a fourth toner circuit board 60D.

The second terminal 53 includes a first group 53A including four (4) second terminals 53, a second group 53B including four (4) second terminals 53, a third group 53C including four (4) second terminal 53, and a fourth group 53D including four (4) second terminals 53.

The second terminals 53 in the first group 53A are connected electrically with the toner terminal 55 in the first toner circuit board 60A, under the condition where the first developing cartridge 13A is attached to the drum frame 12 of the drum cartridge 10. The second terminals 53 in the second group 53 are connected electrically with the toner terminal 55 in the second toner circuit board 60B, under the condition where the second developing cartridge 13B is attached to the drum frame 12 of the drum cartridge 10. The second terminals 53 in the third group 53C are connected electrically with the toner terminal 55 in the third toner circuit board 60C, under the condition where the third developing cartridge 13C is attached to the drum frame 12 of the drum cartridge 10. The second terminals 53 in the fourth group 53D are connected electrically with the toner terminal 55 in the fourth toner circuit board 60D, under the condition where the fourth developing cartridge 13D is attached to the drum frame 12 of the drum cartridge 10.

The second terminals 53 in each of the first through fourth groups 53A-53D each include the second power-supplier terminal 531, the second data terminal 532, the second ground terminal 533, and the second clock terminal 534.

The first through fourth toner circuit boards 60A-60D in the first through fourth developing cartridges 13A-13D each include the toner terminal 55. The toner terminals 55 each include a toner power-supplier terminal 551, a toner data terminal 552, a toner ground terminal 553, and a toner clock terminal 554.

The main wire 310 on the main board 31 includes a power-supplier wire 311, a data wire 312, a ground wire 313, a clock wire 314, a constant-voltage supplier wire 315, and a measurer wire 316.

The power-supplier wire 311 is connected electrically with the main power-supplier terminal 511 on one end and with an ASIC (integrated circuit) 319 in the controller 3 on the other end through a drawer-system power source 318. The ASIC 319 includes a processor. The ASIC 319 is mounted on the main board 31 and is connected with a RAM and a ROM.

The data wire 312 is connected electrically with the main data terminal 512 on one end and with the ASIC 319 on the other end.

The ground wire 313 is connected electrically with the main ground terminal 513 on one end. The other end of the ground wire 313 is grounded.

The clock wire 314 is connected electrically with the main clock terminal 514 on one end and with the ASIC 319 on the other end.

The constant-voltage supplier wire 315 (see FIG. 8) is electrically connected with the constant-voltage supplier terminal 571 in the thermistor-assigned main terminal 57 on one end and with the ASIC 319 on the other end.

The measurer wire 316 is connected electrically with the measurer terminal 572 in the thermistor-assigned main terminal 57 on one end and with the ASIC 319 on the other end. The measurer wire 316 is grounded at an intermediate position between the measurer terminal 52 and the ASIC 319 through a fixed resistor 801.

The relay wire 54 on the relay board 101 includes a power-supplier relay wire 541, a data relay wire 542, ground relay wires 543*a*, 543*b*, a clock relay wire 544, a constant-voltage supplier wire 545, and a measurer wire 546.

The power-supplier relay wire 541 is connected electrically with the first power-supplier terminal 521 on one end. On the other end, the power-supplier relay wire 541 is branched into six (6) lines, which are connected electrically with the second power-supplier terminal 531 in the first group 53A, the second power-supplier terminal 531 in the second group 53B, the second power-supplier terminal 531 in the third group 53C, the second power-supplier terminal 531 in the fourth group 53D, a multiplexer 108, and the drum memory 102.

The data relay wire 542 is connected electrically with the first data terminal 522 on one end. On the other end, the data relay wire 542 is branched into two (2) lines, which are connected electrically with the multiplexer 108 and the drum memory 102. The data relay wire 542 connected to the multiplexer 108 is further branched into four (4) lines within the multiplexer 108 to be connected electrically with the second data terminal 532 in the first group 53A, the second data terminal 532 in the second group 53B, the second data terminal 532 in the third group 53C, and the second data terminal 532 in the fourth group 53D.

The ground relay line 543*a* is connected electrically with the first ground terminal 523 on one end, and the other end of the ground relay wire 543*a* is grounded. The ground relay wire 543*b* is branched on one end into four (4) lines, which are connected electrically with the second ground terminals 533 in the first through fourth groups 53A-53D. The other end of the ground relay wire 543*b* is grounded.

The clock relay wire 544 is connected electrically with the first clock terminal 524 on one end. On the other end, the clock relay wire 544 is branched into two (2) lines, which are connected with the multiplexer 108 and the drum memory 102. The clock relay line 544 connected to the multiplexer 108 is further branched into four (4) lines within the multiplexer 108 to be connected electrically with second clock terminal 534 in the first group 53A, the second clock terminal 534 in the second group 53B, the second clock terminal 534 in the third group 53C, and the second clock terminal 534 in the fourth group 53D.

The constant-voltage supplier wire 545 is connected electrically with the constant-voltage supplier terminal 581 in the thermistor-assigned terminal 58 on one end and with the thermistor 107 on the other end.

The measurer wire 546 is connected electrically with the measurer terminal 582 in the thermistor-assigned terminal 58 on one end and with the thermistor 107 on the other end.

With the electrical connections among the boards as described above, when the developing cartridges 13 are attached to the drum cartridge 10, and when the drum cartridge 10 is attached to the body frame 99 of the main body 2, connections between the main terminal 51 and the toner terminals 55 are established through the main-body wires, which connect the body-side connector and the controller 3, the body-side connector, the second connector 104, the second wire 106, the relay board 101, the first wire 105, and the first connectors 103. Thus, the controller 3 is enabled to read information in the drum memory 102, write information in the drum memory 102, read information in the toner memories 15, and write information in the toner memories 15.

Moreover, by establishing the electrical connection between the main power-supplier terminal 511 on the main board 31, on which the controller 3 is mounted, and the power-supplier terminal 521 on the relay board 101, the power may be supplied to the relay board 101 through the controller 3. The first power-supplier terminal 521 is connected electrically with the four (4) second power-supplier terminals 531 and the drum memory 102 through the power-supplier relay wire 541 within the relay board 101. Further, the second power-supplier terminals 531 are connected electrically with the toner power-supplier terminals 551 on the toner circuit boards 60. Thereby, the power from the drawer-system power source 318 may be supplied to the toner circuit boards 60 through the relay board 101 and the drum memory 102 on the relay board 101.

Meanwhile, by establishing the electrical connection between the ASIC 319 in the controller 3 with the constant-voltage supplier terminal 571, the power may be supplied from the ASIC 319 to the relay board 101. The constant-voltage supplier terminals 571, 581 are connected electrically with the thermistor 107 through the constant-voltage supplier wire 545. Thus, a constant voltage may be applied by the controller 3 to the thermistor 107. Thereby, the voltage in the measurer wire 316 may vary based on a ratio between the resistance values of the fixed resistor 801 and the variable resistance in the thermistor 107. Based on the voltage values, the ASIC 319 may calculate a value of a result of detection representing the temperature. Moreover, based on the temperature being the result of detection by the thermistor 107, the controller 3 may control the fan 23. For example, when the controller 3 determines that the temperature detected by the thermistor 107 is higher than a predetermined temperature, the controller 3 may increase a rotational speed of the fan 23. For another example, when the controller 3 determines that the temperature detected by the thermistor 107 is lower than the predetermined temperature, the controller 3 may reduce the rotational speed of the fan 23.

Thus, according to the embodiment, the supplying channel to supply the power to the thermistor 107 and the suppling channel to supply the power to the toner circuit boards 60 are arranged in different locations. Therefore, the power supply to the thermistor 107 may be switched on or off independently from switching on or off of the power supply to the toner memories 15.

6. First Modified Example of Electrical Connections Among the Boards

Figure 9:
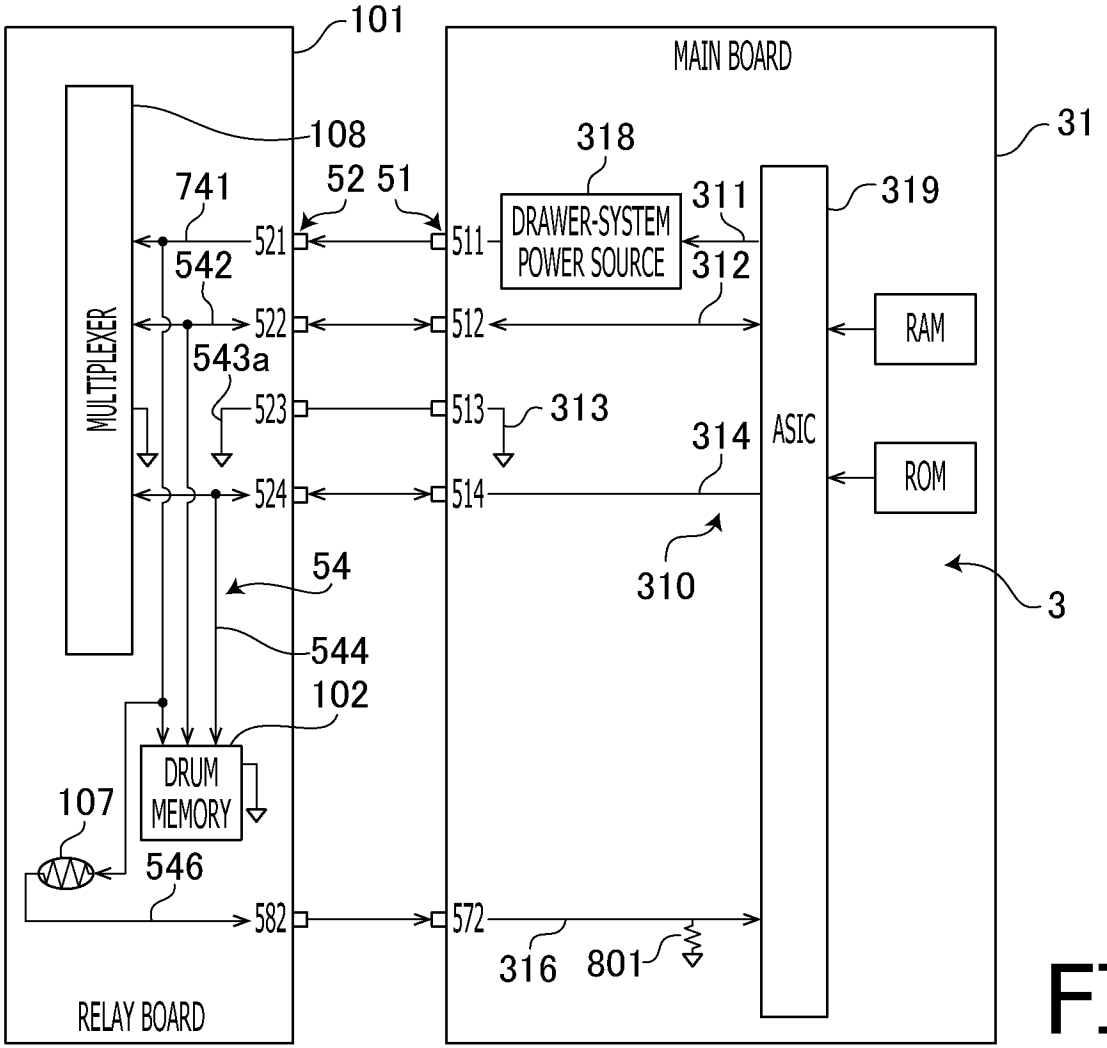
FIG. 9 illustrates another arrangement and connections among the boards in the drum cartridge and the image forming apparatus according to a first modified example of the embodiment of the present disclosure.

In the following paragraphs, with reference to FIG. 9, described will be a first modified example of the electrical connection between the relay board 101 and the controller 3 according to the embodiment of the present disclosure. FIG. 9 is a block diagram to illustrate arrangement and electrical connections between the controller 3 and the relay board 101 according to the first modified example. The electrical arrangement in the first modified example differs from the electrical arrangement in the previous embodiment described above in that the constant-voltage supplier wire 315, the constant-voltage supplier terminals 571, 581, and the constant-voltage supplier wire 545 are omitted. Moreover, the electrical arrangement in the first modified example differs from the electrical arrangement in the previous embodiment described above in that a power-supplier relay wire 741 is provided in place of the power-supplier relay wire 541. In the following description, structures, parts, or items identical or similar to those described in the previous embodiment may be referred to by a same reference sign, and redundant explanation of those will be omitted.

The power-supplier relay wire 741 is electrically connected with the first power-supplier terminal 521 on one end. On the other end, the power-supplier relay wire 741 is branched into seven (7) lines, which are connected with the second power-supplier terminal 531 in the first group 53A, the second power-supplier terminal 531 in the second group 53B, the second power-supplier terminal 531 in the third group 53C, the second power-supplier terminal 531 in the fourth group 53D, the multiplexer 108, the drum memory 102, and the thermistor 107.

In this arrangement, by establishing the electrical connection between the main power-supplier terminal 511 on the main board 31, on which the controller 3 is mounted, and the first power-supplier terminal 521 on the relay board 101, the power may be supplied from the controller 3 to the relay board 101. The first power-supplier terminal 521 is connected electrically with the four (4) second power-supplier terminals 531, the drum memory 102, and the thermistor 107 through the power-supplier relay wire 741. Therefore, the power from the drawer-system power source 318 may be supplied to the four (4) toner circuit boards 60 through the relay board 101, and to the drum memory 102 and the thermistor 107 within the relay board 101. In this arrangement, by sharing the power source between the toner memories 15 and the thermistor 107, the quantity of the first terminals 52 may be reduced.

7. Second Modified Example of Electrical Connections Among the Boards

Figure 10:
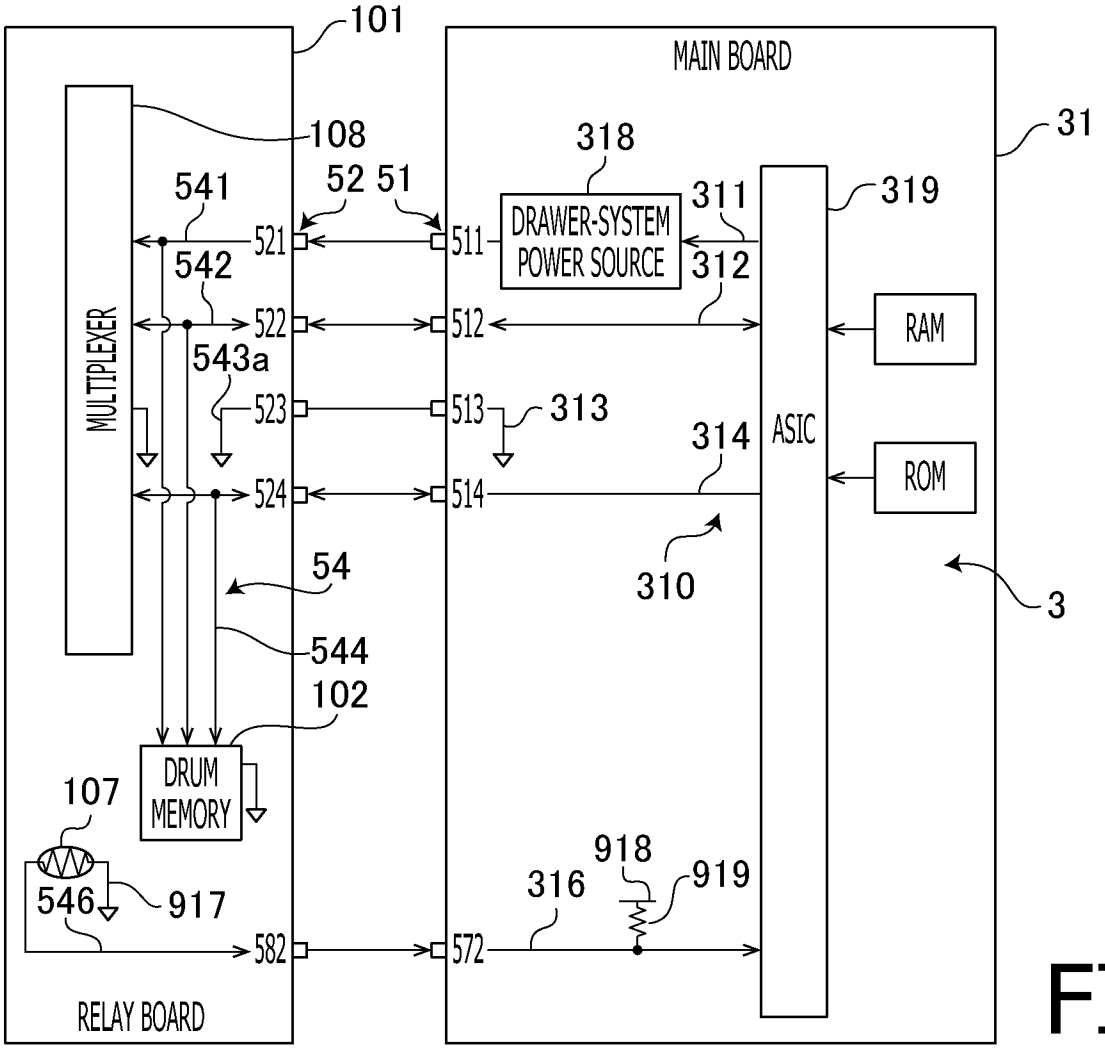
FIG. 10 illustrates another arrangement and connections among the boards in the drum cartridge and the image forming apparatus according to a second modified example of the embodiment of the present disclosure.

In the following paragraphs, with reference to FIG. 10, described will be a second modified example of the electrical connection between the relay board 101 and the controller 3 according to the embodiment of the present disclosure. FIG. 10 is a block diagram to illustrate arrangement and electrical connections between the controller 3 and the relay board 101 according to the second modified example. The electrical arrangement in the first modified example differs from the electrical arrangement in the embodiment described earlier in that the constant-voltage supplier wire 315, the constant-voltage supplier terminals 571, 581, and the constant-voltage supplier wire 545 are omitted. Moreover, the electrical arrangement in the second modified example differs from the electrical arrangement in the embodiment described earlier in that a power-supplier circuit 918 is mounted on the main board 31.

The power-supplier circuit 918 is a circuit mounted on the main board 31 and is located at a position different from the drawer-system power source 318. The power-supplier circuit 918 is connected to an intermediate position on the measurer wire 316 between the AISC 319 and the measurer terminal 572 through a fixed resistor 919 at an intervening position. A wire 917 on the relay board 101 extending from the thermistor 107, which is a wire different from the measurer wire 546, is grounded.

In this arrangement, by establishing the electrical connection between the main power-supplier terminal 511 on the main board 31, on which the controller 3 is mounted, and the first power-supplier terminal 521 on the relay board 101, the power may be supplied from the controller 3 to the relay board 101. The first power-supplier terminal 521 is connected electrically with the four (4) second power-supplier terminals 531 and the drum memory 102 through the power-supplier relay wire 541. Therefore, the power from the drawer-system power source 318 may be supplied to the four (4) toner circuit boards 60 through the relay board 101 and to the drum memory 102 within the relay board 101.

Meanwhile, the constant voltage may be applied from the power-supplier circuit 918 to one end of the fixed resistor 919. Thereby, the voltage in the measurer wire 316 may vary based on a ratio between the resistance values of the fixed resistor 919 and the variable resistance in the thermistor 107. Based on the voltage value, the ASIC 319 may calculate a value of the result of detection representing the temperature.

Thus, by not connecting the power-supplier circuit 918 directly to the thermistor 107, a quantity of the first terminals 52 may be reduced.

8. Benefits

As has been described above, the drum cartridge 10 in the embodiment according to the present disclosure has the photosensitive drums 11, the drum memory 102, the drum frame 12, the first connectors 103, the relay board 101, the second connector 104, and the thermistor 107. The thermistor 107 is electrically connectable with the relay board 101 through the thermistor-assigned terminal 58. Thus, while the drum cartridge 10 has the relay board 101, which relays electricity between the first connectors 103 and the second connector 104, the thermistor 107 may be mounted on the drum cartridge 10 easily. In this regard, when the thermistor 107 fails to operate correctly, a user may access the thermistor 107 on the drum cartridge 10 to exchange the thermistors 107 easily.

With the drum cartridge 10 according to the embodiment, moreover, the thermistor 107 enables detection of the temperature in the vicinity of the developing cartridges 13. Therefore, the controller 3 may estimate the temperature of the developing agents in the developing cartridges 13 while disturbance of the temperature in the exterior environment may be restrained from affecting, and the temperature may be adjusted through the air conditioning control.

With the drum cartridge 10 according to the embodiment, moreover, the thermistor 107 is mounted on the relay board 101. Therefore, compared to a case, in which the thermistor 107 is located outside off from the relay board 101, a volume of the drum cartridge 10 may be reduced. Further, the drum cartridge 10 may not require a cable to connect the thermistor 107 and the relay board 101; therefore, a manufacturing cost may be lowered.

With the drum cartridge 10 according to the embodiment, moreover, the third frame 12*c* is located on the upstream side in the attaching direction, in which the drum frame 12 is attachable to the body frame 99 of the main body 2. Therefore, at the position on the downstream side in the attaching direction, where the temperature tends to rise more easily, the temperature may be detected at the position in the vicinity of the developing cartridges 13 through the thermistor 107.

With the drum cartridge 10 according to the embodiment, moreover, under the condition where the developing cartridges 13 are attached to the drum frame 12 and the drum cartridge 10 is attached to the body frame 99, the thermistor 107 is located between the developing cartridges 13 and the fuser 24.

With the drum cartridge 10 according to the embodiment, moreover, the drum frame 12 has the cover 14 to protect the thermistor 107. Therefore, thermistor 107 may avoid being exposed to the developing agent, e.g., toner.

With the drum cartridge 10 according to the embodiment, moreover, the relay board 101 has the first power-supplier terminal 521, through which the power may be supplied to the toner memories 15, and the constant-voltage supplier terminal 581, through which the power may be supplied to the thermistor 107, separately. Therefore, the power supply to the thermistor 107 may be switched on or off independently from switching on or off of the power supply to the toner memories 15.

With the drum cartridge 10 according to the embodiment, moreover, the relay board 101 has the first power-supplier terminal 521, which is a common terminal to supply the power to the drum memory 102, the toner memories 15, and the thermistor 107. Therefore, the power supply to the thermistor 107 may be switched on or off in synchronization with the switching on or off of the power supply to the drum memory 102 and the toner memories 15.

9. More Examples

Although examples of carrying out the invention have been described, those skilled in the art will appreciate that there are numerous variations and permutations of the drum cartridge and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described examples of modifications to the present embodiment.

For example, the drum memory 102 and the thermistor 107 may not necessarily be arranged separately on the relay board 101, but the thermistor 107 may be located on the drum memory 102.

For another example, the cover 14 may have a ventilation hole.

For another example, the relay board 101 may be arranged in a posture perpendicular to the second direction.

It is to be understood that the subject matter defined in the appended claims may not necessarily be limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. A drum cartridge for use with a developing cartridge, the drum cartridge comprising:
- a photosensitive drum;
- a drum frame;
- a drum memory storing information concerning the photosensitive drum;
- a thermistor; and
- a connector electrically connectable with an image forming apparatus, the connector being electrically connectable with the drum memory and the thermistor.

2. The drum cartridge according to claim 1, further comprising:
- a board electrically connectable with the drum memory and the thermistor,
- wherein the connector is electrically connectable with the drum memory and the thermistor through the board.

3. The drum cartridge according to claim 2, wherein the drum memory is positioned on the board.

4. The drum cartridge according to claim 2, wherein the thermistor is positioned on the board.

5. The drum cartridge according to claim 2, wherein the board includes a power-supplier terminal configured to supply power to the drum memory and the thermistor.

6. The drum cartridge according to claim 1, wherein the thermistor is positioned on the drum memory.

7. The drum cartridge according to claim 1, wherein the thermistor is positioned on an outer surface of the drum frame.

8. The drum cartridge according to claim 1, wherein the photosensitive drum is rotatable about a drum axis extending in a first direction,
- wherein the drum frame includes:
  - a first frame positioned at one end of the photosensitive drum in the first direction;
  - a second frame positioned at another end of the photosensitive drum in the first direction;
  - a third frame connecting one end of the first frame in a second direction and one end of the second frame in the second direction, the second direction interesting with the first direction; and
  - a fourth frame connecting another end of the first frame in the second direction and another end of the second direction in the second direction, and
- wherein the photosensitive drum is positioned between the third frame and the fourth frame in the second direction.

9. The drum cartridge according to claim 8, wherein the thermistor is positioned at the fourth frame, and
- wherein the connector is positioned at the fourth frame.

10. The drum cartridge according to claim 9, wherein the thermistor is positioned on an outer surface of the fourth frame, and
- wherein the connector is positioned on the outer surface of the fourth frame.

11. The drum cartridge according to claim 10, wherein the connector is positioned at one side of the fourth frame in the first direction, and
- wherein the thermistor is positioned at another side of the fourth frame in the first direction.

12. The drum cartridge according to claim 8, wherein the drum frame has a slot, to which the developing cartridge is attachable, and
- wherein the photosensitive drum and the slot are positioned between the third frame and the fourth frame in the second direction.

13. The drum cartridge according to claim 1, wherein the drum frame includes a cover configured to cover the thermistor.

14. The drum cartridge according to claim 1, wherein the developing cartridge is detachably attachable to the drum frame.

15. The drum cartridge according to claim 1, wherein the developing cartridge includes a toner memory storing information concerning the developing cartridge.

16. The drum cartridge according to claim 1, wherein the connector is electrically connectable with a main connector of the image forming apparatus.

* * * * *